United States Patent [19]

Adams

[11] Patent Number: 5,007,111

[45] Date of Patent: Apr. 16, 1991

[54] SHOCK ABSORBING BOOT AND CUSHIONING MATERIAL

[76] Inventor: Mark B. Adams, 206 Ransui Mansion, 1-10 Minamizemi, Gifu Shi, Gifu Ken, Japan, T502

[21] Appl. No.: 407,332

[22] Filed: Sep. 14, 1989

[51] Int. Cl.[5] ..... A41D 13/06

[52] U.S. Cl. ..... 2/22; 2/2

[58] Field of Search ..... 2/242, 241, 239, 22, 2/2, 411, 413

[56] References Cited

U.S. PATENT DOCUMENTS

| | | | |
|---|---|---|---|
| 1,498,829 | 6/1924 | Blum | 2/242 |
| 2,563,763 | 8/1951 | Vietas | 2/22 |
| 2,774,152 | 12/1956 | Alber | 2/22 |
| 3,003,154 | 10/1961 | Litman | 2/239 |
| 3,268,912 | 8/1966 | Whelan | 2/22 |
| 3,475,835 | 11/1969 | Kovar | 2/22 |
| 3,550,159 | 12/1970 | Alarco | 2/2 |
| 3,621,489 | 11/1971 | Keller | 2/22 |
| 3,999,220 | 12/1976 | Keltner | 2/2 |
| 4,067,063 | 1/1978 | Ettinger | 2/22 |
| 4,099,269 | 7/1978 | Porner | 2/16 |
| 4,266,298 | 5/1981 | Graziano | 2/22 |
| 4,373,361 | 2/1983 | Thorneburg | 2/241 |
| 4,422,183 | 12/1983 | Landi et al. | 2/2 |
| 4,497,070 | 2/1985 | Cho | 2/22 |
| 4,513,449 | 4/1985 | Donzis | 2/22 |
| 4,669,126 | 6/1987 | Jones | 2/239 |
| 4,769,854 | 9/1988 | Williams | 2/22 |
| 4,905,320 | 3/1990 | Squyers, Jr. | 2/22 |

FOREIGN PATENT DOCUMENTS

| | | | |
|---|---|---|---|
| 2068710 | 8/1981 | United Kingdom | 2/22 |

*Primary Examiner*—William A. Cuchlinski, Jr.
*Assistant Examiner*—C. W. Fulton
*Attorney, Agent, or Firm*—M. Reid Russell

[57] ABSTRACT

A cushion pad arrangement for protecting a person's extremity from compressive and side to side rubbing stresses, as particularly occur at a person's shin, ankle and foot as a result of wearing a boot during use, such as a ski boot during skiing. The cushion pads are formed as a sandwich of serially and parallel connected cells arranged between top and bottom layers, which cells and connecting tubes are formed of a somewhat resilient material, and are selectively filled with air, liquid or gel, depending upon the anticipated forces the pad is intended to cushion, the cushion pads to provide an increasing force dispersion with increasing pressures.

29 Claims, 7 Drawing Sheets

SHOCK ABSORBING BOOT AND CUSHIONING MATERIAL

BACKGROUND OF THE INVENTION

1. Field of the Invention

This invention relates to protective devices and more particularly to devices for maintaining a protective padding or cushioning over an area of a person's body.

Prior Art

Limb protection devices including arrangements for positioning a pad or pads over a particular surface are not new. Some examples of such earlier devices include an inflatable heel protector by Graziano, U.S. Pat. No. 4,266,298, and an inflatable bag by Conroy, U.S. Pat. No. 3,784,985, that is for use with a curvilinear athletic pad to protect a person's arm or leg. Neither of which devices includes a cellular shock pad or mounting therefore like that of the present invention.

Further, a protective device is shown in a patent to Porner, U.S. Pat. No. 4,099,269, that includes a pad that includes a plurality or resilient layers rather than a cellular configuration for fitting it to an extremity, either human or animal. Finally, a patent to Keller, U.S. Pat. No. 3,621,489, shows a shin guard arrangement that, like the preferred embodiment of the present invention, is for cushioning an athlete's shin area from contact with a boot top. The Keller guard, however, involves a conventional pad that is fitted over a split sleeve formed of, essentially, a non-compliant material. Whereas, the present invention provides a unique shock pad that includes a cellular flow component therewith and an arrangement for securing individual shock pads so as to cover contact zones of a person's extremity.

SUMMARY OF THE INVENTION

It is a principal object of the present invention to provide a cellular pad as a flow cushioning arrangement and structure for maintaining it over an area of a person's extremity to be protected.

Another object of the present invention is to provide a sock with an arrangement for releasably mounting sections of cushioning material to areas of the sock for covering portions of the wearer's foot.

Another object of the present invention is to provide a cushioning pad arrangement that includes individual and/or juxtapositioned cell or compartment sections that are serially and parallel connected, for providing increasing levels of compressive force cushioning or dampening.

Still another object of the present invention is to provide a cushioning material that is made up of patterns of static and connected air, liquid or gel filled cells or compartments that are formed into cushion sections, providing flow paths between which cells or compartments such that, when a force is exerted thereon, the cushioning material spreads the load through fluid movement into the interconnected cells or compartments.

In accordance with the above objects the present invention is in a system for strategically arranging and maintaining a cellular cushioning material over a section or portion of a person's extremity that is subjected to compressive and/or side to side stresses. For example, one utilization of the invention involves a bootie or sock that is for fitting onto a person's foot, the bootie or sock top drawn to above their shin area. The bootie or sock is formed to include or provide for strategically positioning cushion pads formed from cell sections to its outer surface. The cushion pads are to cover areas of the wearer's foot as are subjected to pressure or scuffing from an inner surface of a shoe, boot, or the like, that is worn on that foot. For example, the bootie or sock provides for maintaining cushion pads across the person's shin, heal bone and instep areas, which cushion pads are further appropriate for protecting other body areas, or as a packing material, or the like.

The present invention preferably involves cushion pads having characteristics of pressure dispersion by promoting flow between cells or compartments arranged as sections that are appropriate for cushioning different stress concentrations. Essentially, the cushion pads consist of different configurations of single and connected cells or compartments, with the multiple connected cells linked in series or parallel or both through tubes or capillaries that provide a flow between which cells or compartments. The cells or compartments are filled with air, water, or gel, or a combination thereof. In practice, the cell or compartment pattern and contents are selected to provide a cushioning effect that is graded for cushioning successively greater loads, supporting levels for the stresses as are anticipated to be exerted at a specific location.

DESCRIPTION OF THE DRAWINGS

In the drawings that illustrate that which is presently regarded as the best mode for carrying out the invention.

DETAILED DESCRIPTION

Figure 1:
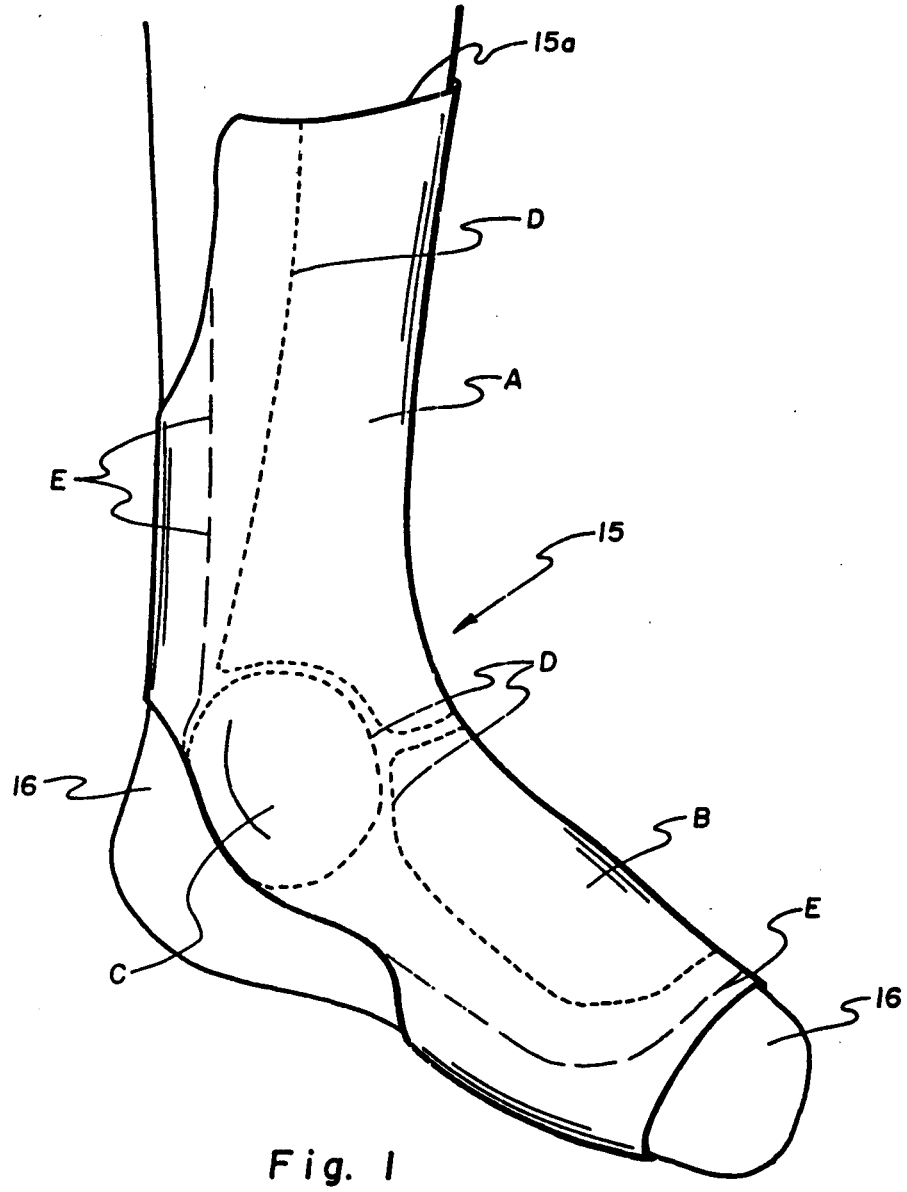
FIG. 1 is a profile perspective view of a first embodiment of the present invention in an ankle bootie that includes integral cellular cushioning pads of the invention.

FIG. 1 shows a bootie 15, that is a first embodiment of the present invention, that is worn on a person's foot 16. The bootie toe and heel areas are shown removed, exposing the toes and heel areas of foot 16. The bootie 15 is preferably formed of a latex, gum rubber, or similar soft, flexible material, and preferably includes integral sections of a cushion material. The sections of cushion material are strategically formed in the bootie manufacture to cover shock zones A, B and C, shown within broken lines D in FIG. 1, where the foot is subjected to compressive and side to side forces as from the inner surface of a boot, not shown, worn on foot 16. The shock zone A is from the bootie top 15*a* to the top of the junction of the ankle and foot, and extends partially around the ankle. A pad over zone A provides cushioning to a person's shin area, protecting it against rubbing and compressive forces as they would experience from wearing a boot, such as a ski or hiking boot. Particularly, from contact with the boot top. A pad over zone B extends from the junction of the ankle with the top of the foot to the bootie toe end and extends across to along opposite sides of the foot. A pad over zone C covers both ankle joint bones that project outwardly from opposite sides of the foot.

Figure 2A:
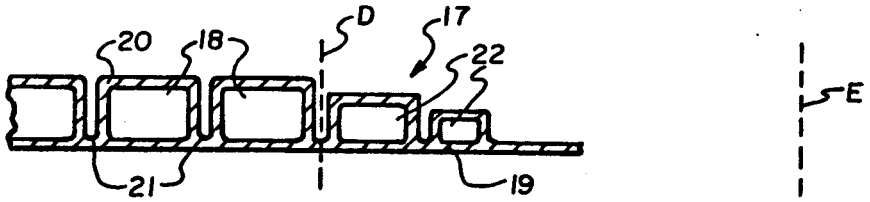
FIGS. 2A and 2B show cross-sections of preferred cellular cushioning pads that are integral to the bootie of FIG. 1, the FIGS. illustrating different arrangements for changing the vertical dimension between a bootie cushioning zone to a nonpadded base zone.
Figure 2B:
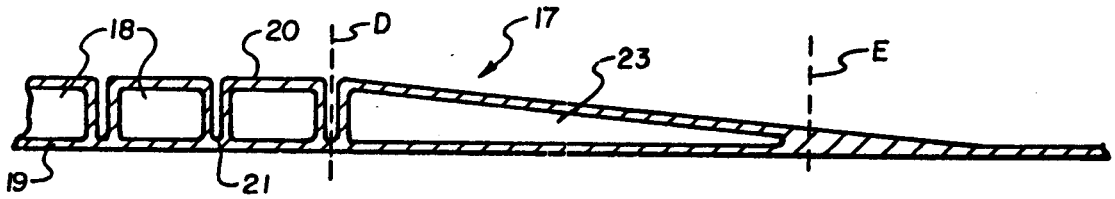

Sections of cushioning material arranged as pads A, B and C of bootie 15 of FIG. 1, each preferably include a transition zone, as shown in broken lines E in FIGS. 1, 2A and 2B, that extends from the section edge, shown as broken line D in FIGS. 1, 2A and 2B, to a junction with the bootie material that is identified as a base zone.

FIGS. 2A and 2B show side elevation sectional views of two arrangements of sections of cushioning material 17 that are formed integral to bootie 15 in the manufacturing process. Shown in FIG. 2A, open compartments 18 are individually formed to extend above the surface of the bootie 19. The individual compartments 18 can be round, hexagon, or other convenient shape, within the scope of this disclosure and may be air, liquid or gel filled. Or can be filled with a combination of air, liquid or gel, as required for efficiently distributing a particular load exerted thereon. The compartments may be formed by a pressure and heat application through a mold to a top layer 20 of latex, or like material. In which process, the top and bottom layers 20 and 19, respectively, bond at junctions 21, forming the individual compartments 18. In that formation, air can be trapped in each compartment, or a liquid or gel can be injected therein during or after compartment formation.

In FIG. 2A and 2B the vertical broken line D is the broken line D of FIG. 1, which line D identifies a line of separation between each of the shock zones A, B, or C from a transition zone between broken lines D and E. From the dotted line D, the compartments are shown as tapering to the base zone, shown as broken lines E. In FIG. 2A, the cells 22 between the broken lines D and E are shown as stepped, from the height of the compartments of shock zones A, B, or C to the base zone which is the bootie 15 thickness. Whereas, FIG. 2B shows a continuous bladder 23 arranged as the transition zone between broken lines D and E.

The transition zones shown in FIGS. 2A and 2B are included to provide a uniformly sloping top layer 20 on the bootie surface for minimizing stress concentrations between the shock zones and the bootie material 19. The preferred compartment height is from 2mm to 5mm in the shock zones A, B, or C, which height is selected for an anticipated force application. With a preferred height to diameter ratio of one-half (½) to one (1), for round or hexagonal compartments.

Figure 3:
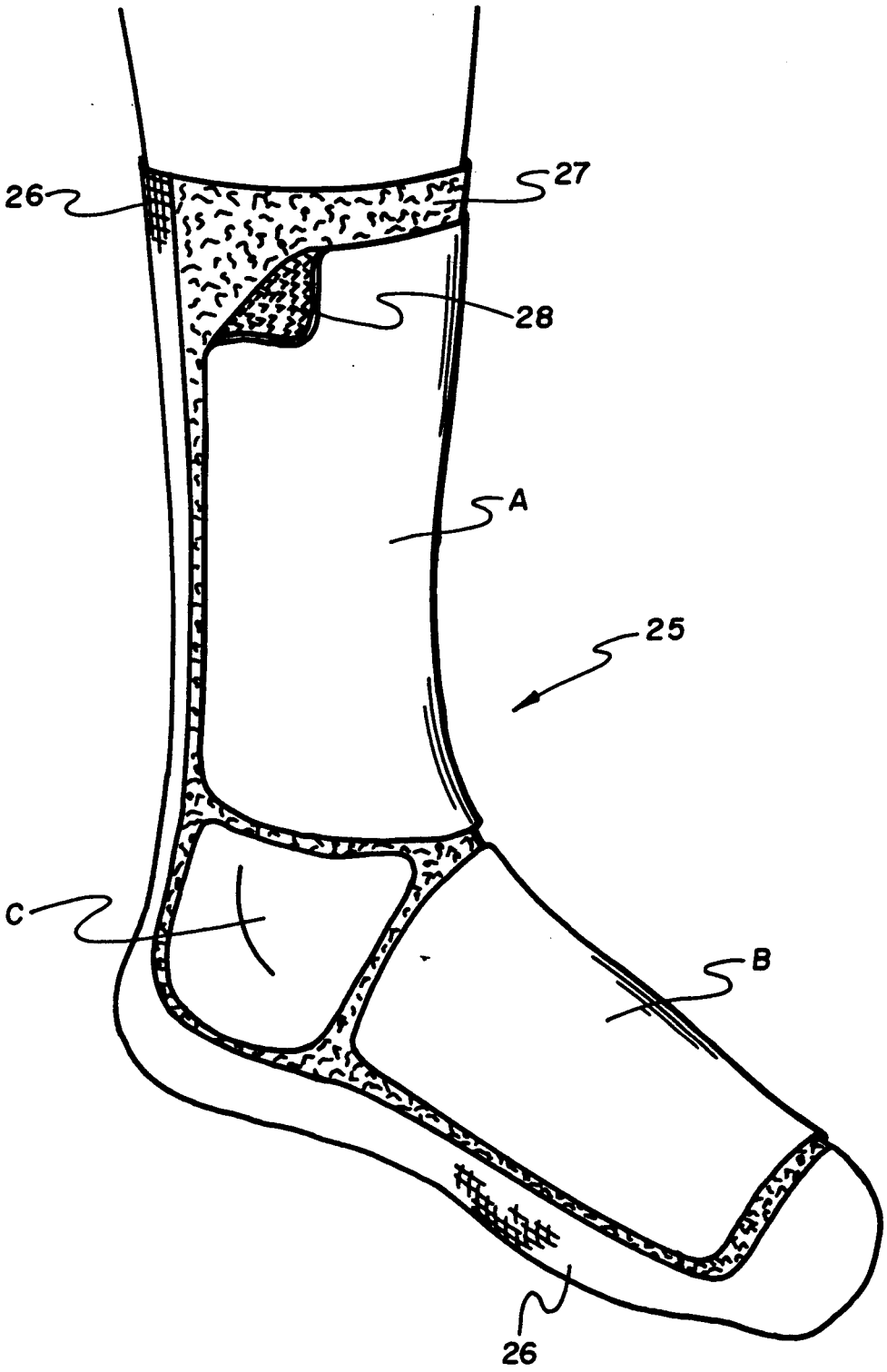
FIG. 3 is a profile perspective view of a second embodiment of the present invention in an ankle sock with separate cellular cushioning pads for positioning thereon.

FIG. 3 illustrates another embodiment of the present invention in a cushioning sock 25, hereinafter referred to as sock. The sock 25 is preferably formed from a conventional stocking material 26 such as nylon, cotton, spandex, or the like that is suitable for the intended wear. Sock 25 is preferably from two (2) to five (5) mm in thickness, and is elastic. A VELCRO® type mat 27 is shown fixed to the stocking material 26, to cover the areas of the foot and ankle identified as shock zones A, B, and C in FIG. 1. Each mat 27 can be separately attached or may, by a selection of the material of sock 25, be a function of that sock material.

Shown in FIG. 3, the shock zone pads are separately installable, utilizing a hook type VELCRO® mat 28 that is fixed across the back face of each of separate cushion pads for covering shock zones A, B, and C. Such hook type mat 28 is for maintaining the cushion pads in place, preferably between the sock 26 outer surface and a boot worn thereover, not shown. Accordingly, the hook type mat 28 need not have as many hooks or be as thick as a typical VELCRO® type hook mat, minimizing sock and cushion zone pad thickness. An assortment of preferred structures of the preferred cushion pads for covering shock zones A, B, and C is set out in detail hereinbelow.

Figure 4:
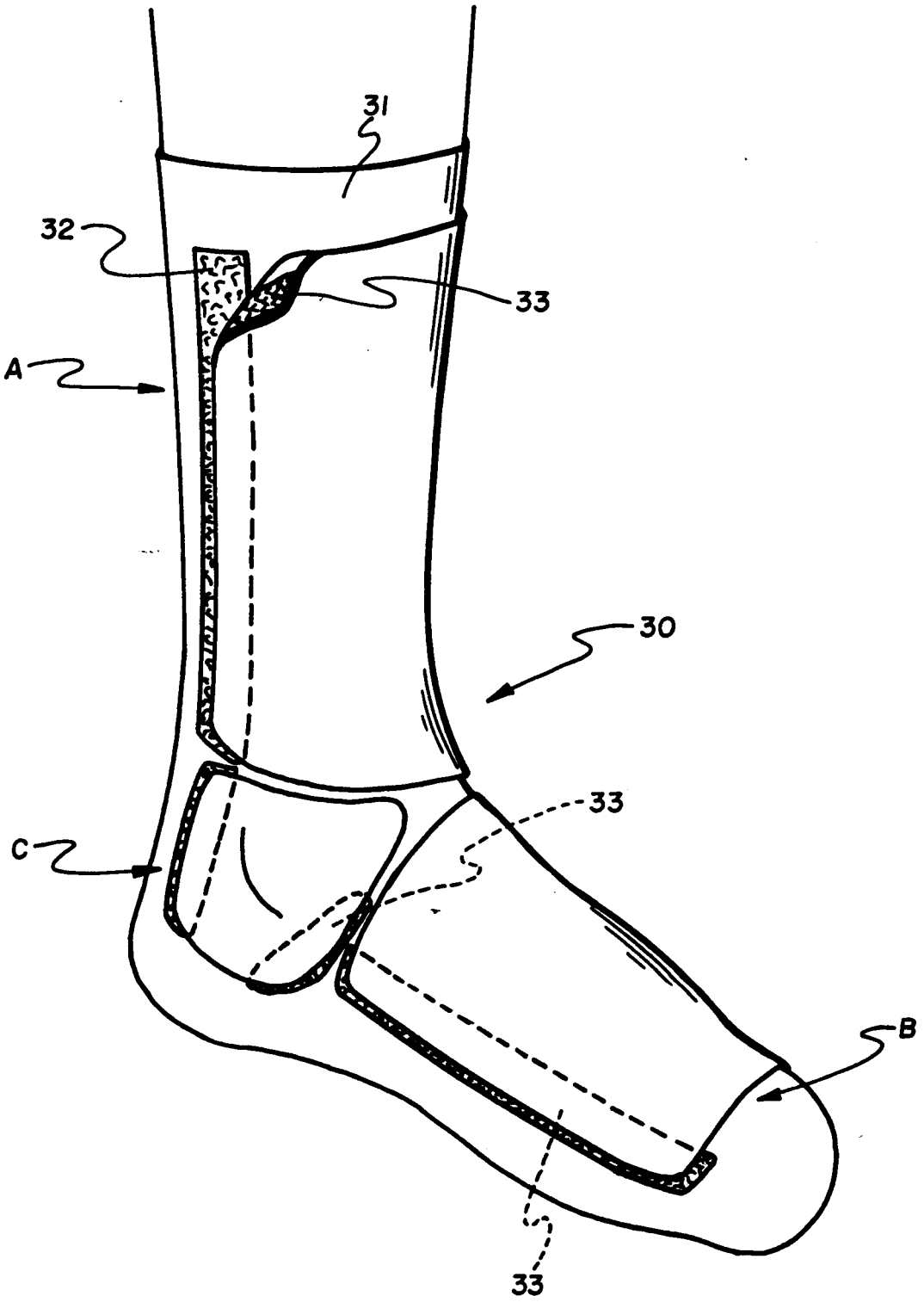
FIG. 4 is still another or a third embodiment of the present invention in an ankle sock that involves still another arrangement of separate cellular cushioning pads for positioning thereon.

FIG. 4 illustrates still another embodiment of a cushioning sock 30, hereinafter referred to as sock, that, like cushioning sock 25 of FIG. 2, provides for attaching separate cushioning pads thereto for covering shock zones A, B, and C. Sock 30, like sock 25 is preferably formed of a conventional stocking material 31. Distinct from sock 25, sock 30 utilizes strips 32 of a VELCRO® type mat that, as shown, are attached along opposite edges of each of the shock zones A, B, and C for receiving, as shown in FIG. 4, sections of VELCRO® type hook pads 33 that are secured to the edges of the cushion pads to connect to strips 32. It should be understood that the cushion pads for both the sock embodiments of FIGS. 3 and 4 are preferably arranged to be easily installed to and removed from a sock, within the scope of this disclosure.

Hereinbelow are set out a number of different arrangements and configurations of cushion pads. Which cushion pads, it should further be understood, are separately useful as padding or packing, within the scope of this disclosure.

FIGS. 5A through 5D show variations of cushion pads 35, 40, 45, and 50 that consist individually of arrangements of six (6) cushion cells or compartments 36 that are serially connected into a hexagon shaped ring with a center cell 37 connected in parallel thereto. The connections between which cells are capillary tubes 38 that provides a flow between the cells when a compressive force is exerted on one or several of the connected cells. So arranged, compressive forces exerted on one or more cells will be distributed between the connected cells. The preferred cushion pad consists of a number of such arrangements of cells 36 and 37, as set out below.

Figure 5A:
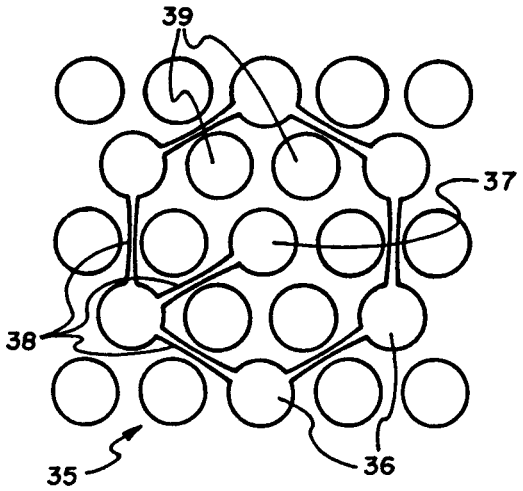
FIGS. 5A through 5D show different cushioning pad configurations that involve patterns of individual serially connected cells that are formed into a closed hexagon, with a parallel connected center cell, with and without one or more static cells in side by side arrangement with static and connected cells, and an overlaying arrangement of static and connecting cells, the pattern of cells forming a cushioning pad section, the cells selectively containing air, fluid, or gel, or combination thereof.

FIG. 5A illustrates the cushion pad 35 as consisting of sections of the six (6) serially connected cells formed of a somewhat resilient material such as a latex or gum rubber, or the like, that are serially connected with capillary tubes 38 to have a hexagon shape, with the parallel connected center cell 37. Additionally, within the hexagonal pattern are shown arranged individual cells 39. The combination of a plurality of the hexagonal ring with center cell 37 and individual cells 39 arranged side by side, covered and filled appropriately, as set out below, make up the cushion pad 35.

Figure 5B:
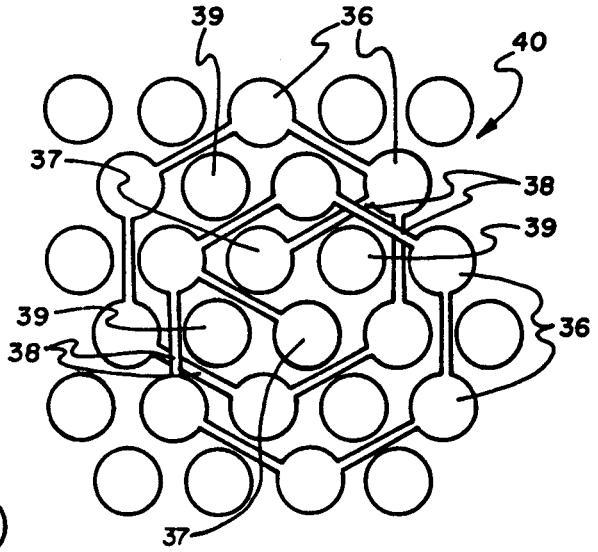

FIG. 5B illustrates a cushioning pad 40 that is an overlapping of the hexagonal rings of six (6) cells 36 that are serially connected by capillary tubes 38 and in parallel to center cushion cell 37. As shown, the overlapping arrangement necessitates a cross-over of certain of the capillary tubes 38. Additionally, single or individual cells 39 are also included to fill in the gaps or spaces between the capillary tube linked cells 36 and 37, which individual cells are covered and filled appropriately, as set out below.

Figure 5C:
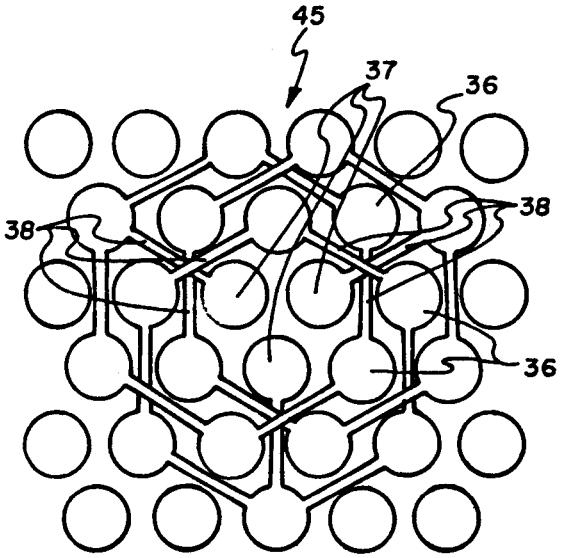
Figure 11:
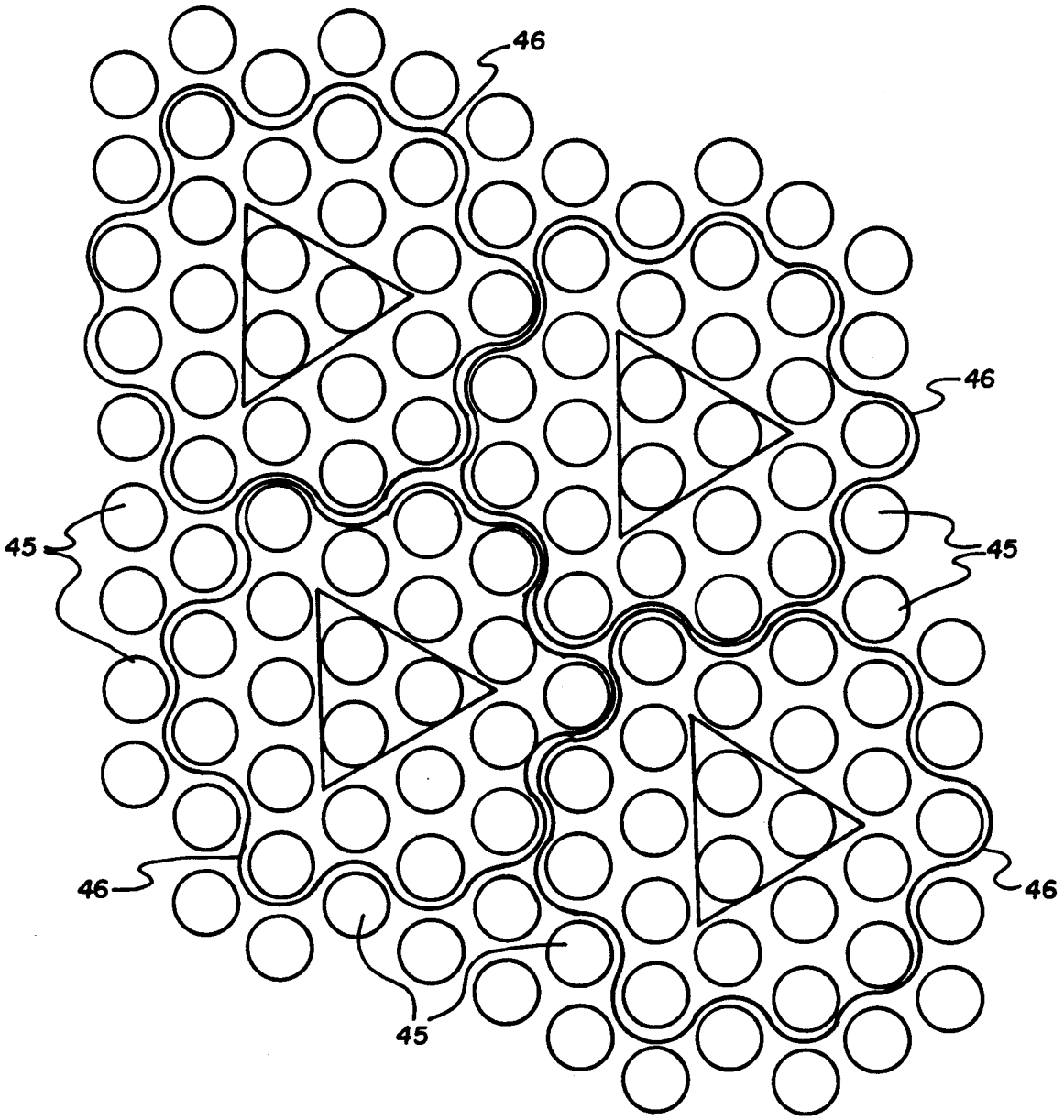
FIG. 11 shows patterns of interconnected independently encased cells like those of FIG. 5C formed into a pad.

FIG. 5C illustrates still another cushioning pad 45 that embodies the six (6) each cells 36 that are serially connected with capillary tubes 38 into a hexagonal ring with a separate cell 37 connected in parallel within each ring. As shown, cushioning pad 45 involves overlaying three (3) each of such hexagonal rings, the separate cells 37 of each ring shown as center cells of the three (3) overlapping rings. The cushion pad 45, like cushion pad 40, includes capillary tubes 38 that cross over one another. The arrangement of the three (3) rings, as shown, or a plurality of a three (3) ring combination make up a section of the cushion pad 45. Which section, shown in FIG. 11, may be separately encased within a cylindrical wrap 46, the individual sections covered top and bottom and filled appropriately to function as independently cushion pad sections.

Figure 5D:
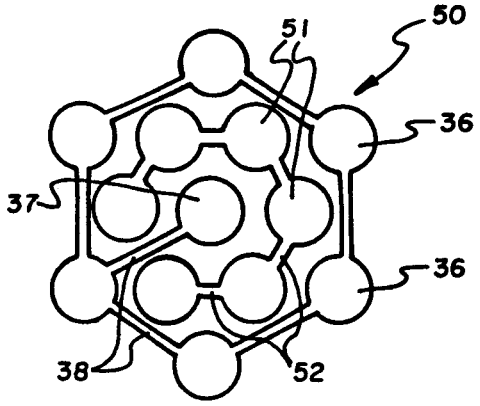

FIG. 5D shows an additional example of a cushion pad 50. Like cushion pads 35, 40, and 45, cushion pad 50 preferably includes the hexagonal ring of six (6) serially connected cells 36 and a separate parallel connected center cell 37. Additionally, cushion pad 50 includes a partial inner ring, shown as consisting of six (6) cells 51 that are serially connected by capillary tubes 52 to fit around the center cell 37. So arranged, the hexagonal ring and inner ring of cells are independent, the capillary tubes 38 and 52 allowing a flow between the cells responsive to a compressive force exerted on one or more of the cells.

Figure 6:
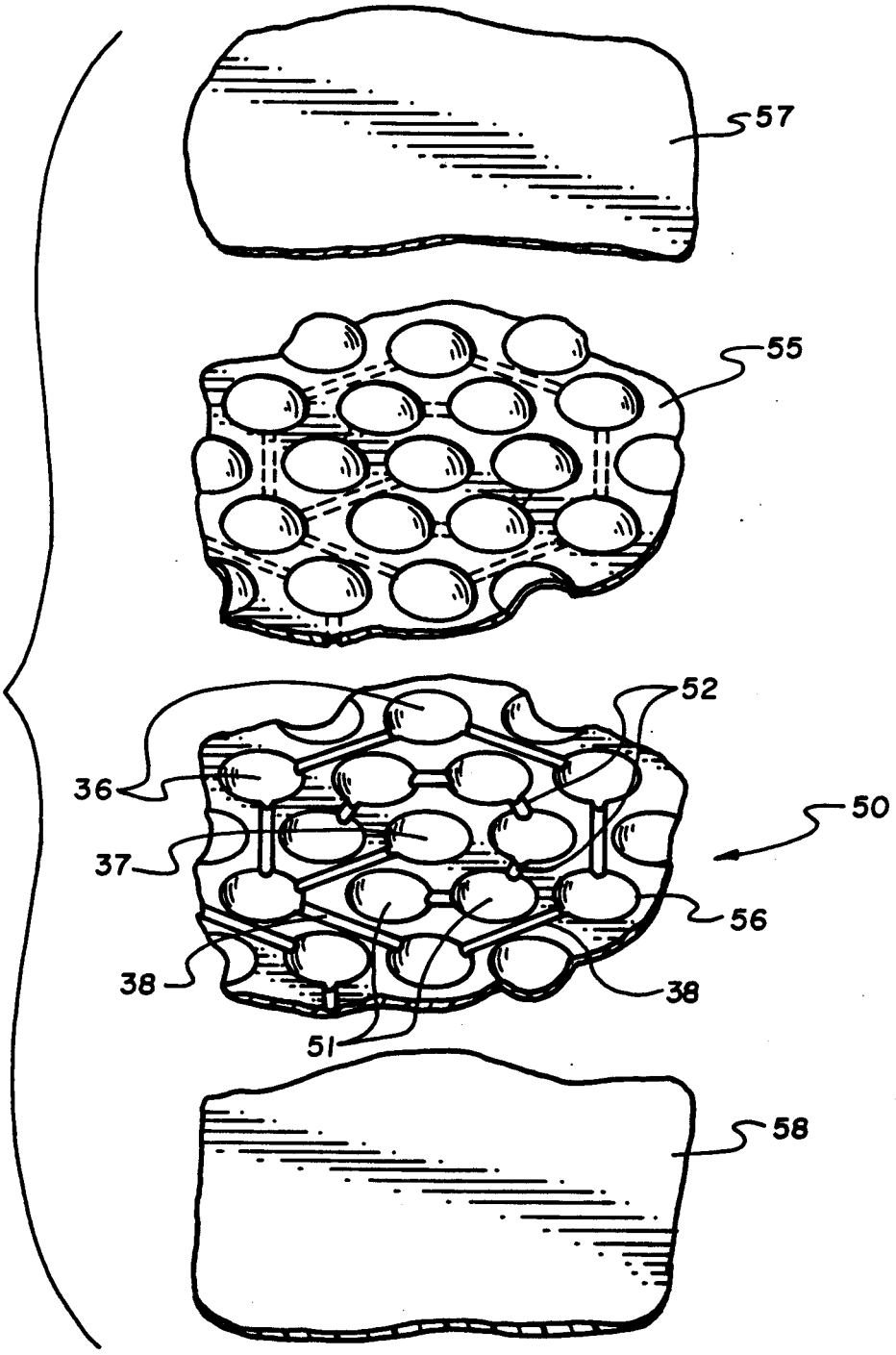
FIG. 6 shows a perspective view taken from the top and one side showing top and bottom cushioning pad sections with top and bottom sheets exploded therefrom.

FIG. 6 shows an example of a fabrication arrangement for forming the cushion pad 50 that involves a sandwich of top and bottom layers, 55 and 56, respectively, that are each fabricated, as by vacuum forming methods from somewhat resilient material, such as latex or gum rubber (or "film"). The individual layers are mirror images of one another consisting of hemispherical segments of cells or compartments with half tubular sections therebetween. Accordingly, in the manufacture the top and bottom layers 55 and 56 are aligned over one another such that the hemispherical segments and half tubes will align and, when the layers are bonded together, as with an adhesive layer coated therebetween, they form the described serially connected cells 36, 37 and 51 with capillary tubes 38 and 52 therebetween.

As set out earlier herein, the groupings of individual cells of the respective cushion pads are preferably air, liquid or gel filled, or are filled with a combination thereof. Which liquid is preferably water. Accordingly, in the manufacture, the cells are appropriately filled. For air filled, no other steps in the manufacture other than those set out above need to be performed as air will naturally be trapped within each cell and within capillary tubes. For liquid or gel filled cells, particularly as where individual or serially connected cells are to be air filled, such as the inner ring of cushion pad 50 of FIG. 5D, and other cells, such as those of the hexagonal ring, are to be liquid or gel filled, a separate step is required. Such step can involve selectively injecting a liquid or gel with a welding or sealing at the point of injection, as with a heated hollow needle. The heated needle to create a material flow at the point of entry as it is withdrawn, closing that entry hole. Thereby, a proper or desired cell configuration of air, liquid and/or gel filled can be provided for a particular anticipated force.

Preferably, as shown in FIG. 6, for providing reinforcement and force distribution to the respective cushion pads, top and bottom cover layers 57 and 58, are included. These cover layers are preferably bonded, as with an adhesive layer, or the like, to form the top and bottom surfaces of the cushion pad. Also, in that bonding, where the cells are liquid or gel filled, as from top dead center, a cover layer can fit over the hole 50 to further seal and strengthen the cell integrity, closing off the individual injection points where liquid or gel was injected. Alternatively, within the scope of this disclosure, latex, or a like material, as a liquid can be applied to form the top and bottom cover layers 57 and 58, respectively, such material to flow between and around the cells and capillary tubes and stiffen therebetween, providing additional cushioning.

It should be understood that the above description of a process of manufacture, relating to FIG. 6, is provided for example only, and other vacuum forming or molding methods could be employed, within the scope of this disclosure. Also, the described hexagonal ring, inner ring, individual cells, and further including straight and U-shaped sections and star arrangements of cells, as set out hereinbelow, can be separately formed and fitted together, with or without cover layers, within the scope of this disclosure.

Figure 7:
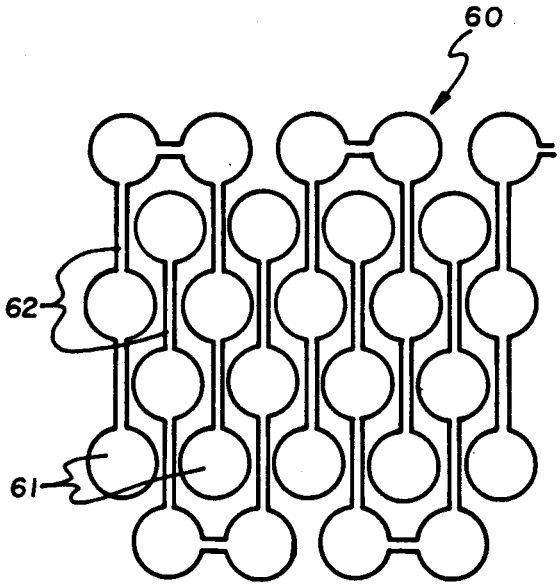
FIG. 7 shows an interdigitated arrangement of serially connected U-shaped cell configurations.

FIG. 7 shows still another arrangement of a section of a cushion pad 60 that employs interdigitated U-shaped segments that are formed of like, serially connected, cells 61 with capillary tubes 62 therebetween. Which arrangement, like the cushion pads described above, can be air, liquid and/or gel filled, and can be sandwiched between cover layers, within the scope of this disclosure.

Figure 8:
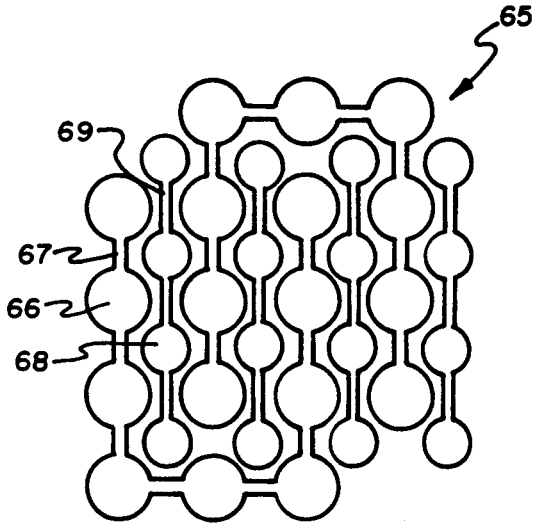
FIG. 8 shows arrangement of serially connected U-shaped cell configurations with lines of serially connected lesser volume cells juxtapositioned therebetween.

FIG. 8, like FIG. 7, shows an interdigitated arrangement of serially connected cells that are formed into a section of cushion pad 65. Distinct therefrom, however, cushion pad 65 consists of both U-shaped sections of cells 66 that are serially connected by capillary tubes 67 along with straight sections of smaller cells 68 serially connected by capillary tubes 69, which cells 68 and capillary tubes 69 are interdigitated between the parallel legs of each U-shaped section. The configurations of cells and their connecting capillary tubes of cushion pad 65 are filled with air, liquid and/or gel to cushion different force distributions, as required.

Figure 9:
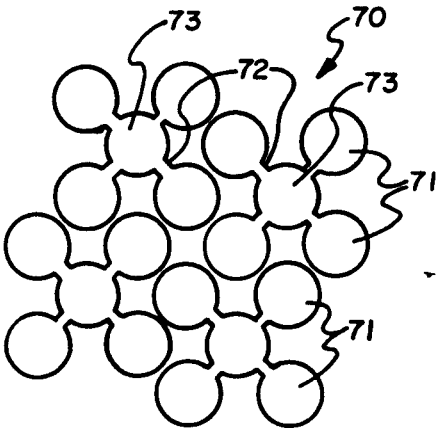
FIG. 9 shows a grouping of star patterns of cells of equal volume.

FIG. 9 shows still another configuration of a section of cushion pad 70 that is a star arrangement of four (4)

cells 71 which radially connect through capillary tubes 72 as spokes to a center cell 73. Which cells 71 and 73 may include cover layers and are air, liquid or gel filled, as determined by the force anticipated to be exerted thereon.

Figure 10:
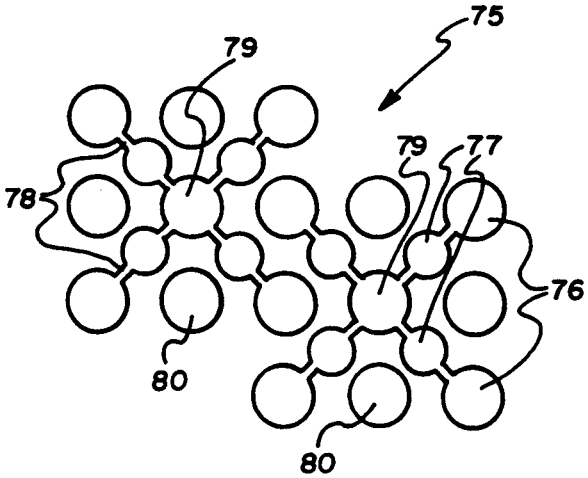
FIG. 10 shows a grouping of star patterns of cells of different volume that further include static cells individually arranged within the legs of the stars, forming squares.

FIG. 10, like FIG. 9, involves a star configuration of cells for forming sections of a cushion pad 75. In this arrangement, however, the stars are preferably formed to include legs of serially connected cells 76 and 77 that are of different volumes and are linked by capillary tubes 78 to extend radially, at equal intervals, from around a center cell 79. Additionally, between which straight legs of the serially connected cells 76 and 77 are preferably arranged individual cushion cells 80. Which linked cells 76, 77, and 79 can be filled with one medium and the individual cushion cells or compartments 80 filled with another or a like medium, which medium can be air, liquid, or a gel, and the sections of cells can be covered with layers, as a sandwich, not shown, within the scope of this disclosure.

The various arrangements of interconnected cells, set out and described above, are preferably formed of somewhat resilient materials, are filled, as described, with air, liquid and/or gel, and are arranged as sections of cushion pads. It should be understood, additional to the cushion pads being utilized to protect a human extremity. The pads are also useful to protect a surface that is expected to receive a point, line or small area stress concentration. The present invention is described for protecting the surface of a person's shin, heel bones, or foot upper surface from stress concentration the foot receives from a boot inner surface, such as ski boot worn on that foot during skiing. Further, it should be obvious that cushion pad configurations, like those shown herein, or the like, could be useful for other body surfaces. Cushion pads like those of the present invention could also be utilized as a packaging material for protecting items of furniture, electrical equipment, or the like. For such varied uses, the anticipated stresses for a particular use thereby determine the preferred configuration of cells and arrangement of capillary tubes therewith, as well as cell filling.

As set out above, the cushion cells within an interlinked section may be of different diameters and volumes. For example, FIGS. 8 and 10 show such arrangements. Also, the volumes of cells in adjacent sections may be different, for providing different displacements, within the scope of this disclosure. Accordingly, it should be understood, cushion pads can be formed from the combination of cells as shown, and the like, to function to disperse or cushion certain force concentrations. Depending on the cell configurations such forces can be dispersed in successive levels of depression, from primary, at the pad surface, through secondary and even tertiary force as pressure is increased and the cushion pad is further depressed. Also, with single cushion cells, force applied thereto would result in compression of the fluid therein whether air, water or gel, and could result in stretching of the cell wall rather than force dispersion. Accordingly, as an applied force increases over one, two, three or even more cushion cells of the present invention, flow will automatically occur from such cells or compartments to others to minimize cell wall stretching, both dispersing such applied force and prohibiting a direct force transfer to the area covered by such cushion pad. Of course, should a layer of latex, or like material be added over and/or through the cells of the cushion pad, an additional cushioning effect will be provided.

While preferred embodiments of the present invention in a shock absorbing boot and cushioning pads have been shown and described herein along with an example of a manufacturing method, it should be understood that the present disclosure is made by way of example only and that variations are possible without departing from the subject matter and reasonable equivalency thereof, coming within the scope of the following claims, which claims I regard as my invention.

I claim:

1. A cushion pad, comprising a plurality of fluid containing resilient cells or compartments as a dispersion array formed in a material; tube means for allowing fluid flow between cells or compartments in said dispersion array of cells, where each dispersion array comprises two or more cells with a first cell, wherein, for said first cell in each said dispersion array, at least one proximal cell is provided, with such proximal cell being a cell that is closer to the first cell than any other cell, and for each first cell at least one distal cell exists in each said dispersion array, a distal cell being any cell that is not a proximal cell; and the first cell in each dispersion array is connected by tube means to at least one distal cell.

2. A cushion pad as recited in claim 1, wherein the cells or compartments are arranged as a sandwich between flat sheets of a plastic material.

3. A cushion pad as recited in claim 1, further including means for maintaining the cushion pad over an area of the human body where stress concentrations are anticipated.

4. A cushion pad as recited in claim 3, wherein the means for maintaining a cushion pad over the area is a sock surface for covering a person's foot with sections of VELCRO® type fasteners fixed to opposing surfaces of said sock surface and cushion pad.

5. A cushion pad as recited in claim 4, wherein the sock is formed to function as a VELCRO® type mat.

6. The cushion pad of claim 1, wherein the first cell in each dispersion array is connected by the means to a plurality of distal cells.

7. The cushion pad of claim 6, where the first cell of each dispersion array is connected to four equidistant distal cells forming a star.

8. A cushion pad as recited in claim 7, wherein a section is made up of a side by side arrangement dispersion arrays formed as stars with equal intervals therebetween.

9. A cushion pad as recited in claim 8, further including closed cells or compartments, each arranged between adjacent straight radiating arms.

10. A cushion pad as recited in claim 9, wherein the radiating arms are made of serially connected cells or compartments of different volumes.

11. The cushion pad of claim 1, further including, with each dispersion array one or more middle cells that are each connected by tube means to two distal cells.

12. A cushion pad as recited in claim 11, wherein the dispersion array of cells or compartments are arranged into a closed hexagon.

13. A cushion pad as recited in claim 11 further including the first cell or compartment linked by tube means to one of the middle cells or compartments.

14. A cushion pad as recited in claim 13, wherein a partial ring of distal cells is arranged within a closed hexagon, partially encircling the first cell or compartment.

15. A cushion pad as recited in claim 14, wherein the hexagonal ring and partial ring are formed of cells or compartments of different volumes.

16. The cushion pad of claim 11, further comprising, with each dispersion array one or more end cells, each connected by tube means to one distal cell.

17. The cushion pad of claim 16, wherein each dispersion array is U-shaped, the cells of each U-shaped dispersion array being interdigitated with the cells of another U-shaped dispersion array.

18. A cushion pad as recited in claim 17, wherein the U-shaped segments and straight segments are formed of serially connected cells or compartments of different volumes.

19. The cushion pad of claim 1, further including, with each tube means, a linking cell arranged between the cells that are connected by said tube means.

20. The cushion pad of claim 1, wherein the cells contain fluid, water, or air.

21. The cushion pad of claim 1, wherein the material is resilient.

22. The cushion pad of claim 21, wherein the material is latex or gum rubber.

23. The cushion pad of claim 1, wherein a plurality of proximal cells or compartments are arranged adjacent to the first cell or compartment, the proximal cells or compartments being equidistant to said first cell or compartment and connected thereto by the tube means.

24. A protective food and shin cushion device comprising, a sock or bootie for wear over a person's foot and extending to cover their shin area; a cushion pad means for arrangement between said sock or bootie and a boot worn on that foot having a plurality of equally spaced cells or compartments that taper from a greater to lesser height from the edge of a shock zone or area to be covered to the surface of the sock or bootie; and means for attaching said cushion pad means to said sock or bootie.

25. A protective foot and shin cushion device as recited in claim 24, wherein the sock or bootie is formed from a soft, flexible material such as latex.

26. A protective foot and shin cushion device as recited in claim 24, wherein the cushion pad means are formed as separate pads for attachment onto the sock or bootie surface.

27. A protective foot and shin cushion device as recited in claim 26, wherein the cushion pads are formed as a sandwich of somewhat flexible cells or compartments that are filled with air, liquid or gel and are individual connected together in series or parallel into sections by tube means, which said sections of cells or compartments are spaced equally from one another and are arranged between top and bottom layers for releasable attachment to said sock or bootie surface.

28. A protective foot and shin cushion device as recited in claim 27, wherein the cells or compartments arranged in sections receive a latex material therearound that sets up to provide further cushioning and forms the top and bottom layers.

29. A protective foot and shin cushion device as recited in claim 28 wherein the cells or compartments in a same or adjacent section are of different volumes.

* * * * *

US005007111C1

(12) EX PARTE REEXAMINATION CERTIFICATE (6981st)

United States Patent

Adams

(10) Number: US 5,007,111 C1

(45) Certificate Issued: Aug. 11, 2009

(54) SHOCK ABSORBING BOOT AND CUSHIONING MATERIAL

(76) Inventor: Mark B. Adams, 206 Ransui Mansion, 1-10 Minamizemi, Gifu Shi, Gifu Ken (JP), T502

Reexamination Request:
No. 90/007,096, Jun. 22, 2004

Reexamination Certificate for:

| | |
|---|---|
| Patent No.: | **5,007,111** |
| Issued: | **Apr. 16, 1991** |
| Appl. No.: | **07/407,332** |
| Filed: | **Sep. 14, 1989** |

(51) Int. Cl.

| | |
|---|---|
| ***A41D 13/00*** | (2006.01) |
| ***A41D 13/06*** | (2006.01) |

(52) U.S. Cl. ..... 2/22; 2/455; 2/910; 2/912

(58) Field of Classification Search ..... 602/13, 602/27–29, 62, 65

See application file for complete search history.

(56) References Cited

U.S. PATENT DOCUMENTS

| | | | |
|---|---|---|---|
| 1,282,980 | A | 10/1918 | Takach |
| 1,317,161 | A | 9/1919 | Hay |
| 1,498,829 | A | 6/1924 | von Blum |
| 1,605,985 | A | 11/1926 | Rasmussen |
| 1,772,310 | A | 8/1930 | Hart |
| 1,852,883 | A | 4/1932 | Gustaveson |
| 2,028,060 | A | 1/1936 | Gilbert |
| 2,136,510 | A | 11/1938 | Jensen |
| 2,201,702 | A | 5/1940 | Rubel |
| 2,274,890 | A | 3/1942 | Cunningham |
| 2,275,575 | A | 3/1942 | Vrooman |
| 2,434,641 | A | 1/1948 | Burns |
| 2,477,588 | A | 8/1949 | Dumm |
| 2,531,074 | A | 11/1950 | Miller |
| 2,563,763 | A | 8/1951 | Vietas |
| 2,575,764 | A | 11/1951 | Momer |
| 2,597,393 | A | 5/1952 | Slampa |
| 2,676,422 | A | 4/1954 | Crawford |
| 2,701,923 | A | 2/1955 | Toman |
| 2,725,646 | A | 12/1955 | Schmidt |
| 2,774,152 | A | 12/1956 | Alber |
| 2,838,099 | A | 6/1958 | Warner |
| 2,874,826 | A | 2/1959 | Matthews et al. |
| 2,938,570 | A | 5/1960 | Flajole |
| 3,003,154 | A | 10/1961 | Litman |
| 3,008,465 | A | 11/1961 | Gal |
| 3,048,931 | A | 8/1962 | Farinello |
| 3,112,956 | A | 12/1963 | Schick et al. |
| 3,192,540 | A | 7/1965 | Swank |
| 3,192,541 | A | 7/1965 | Moore |
| 3,268,912 | A | 8/1966 | Whelan |
| 3,363,941 | A | 1/1968 | Wierwille |
| 3,475,835 | A | 11/1969 | Kovar |
| 3,540,776 | A | 11/1970 | Wilson |
| 3,550,159 | A | 12/1970 | Alarco |
| 3,605,145 | A | 9/1971 | Graebe |

(Continued)

FOREIGN PATENT DOCUMENTS

| | | |
|---|---|---|
| CA | 1143938 | 4/1983 |
| DE | 2800359 | 12/1979 |
| FR | 720257 | 7/1931 |

(Continued)

OTHER PUBLICATIONS

Transcription of Hearing on motion for summary judgment. Declaration of David A. Schulman.

(Continued)

*Primary Examiner*—Beverly M. Flanagan

(57) ABSTRACT

A cushion pad arrangement for protecting a person's extremity from compressive and side to side rubbing stresses, as particularly occur at a person's shin, ankle and foot as a result of wearing a boot during use, such as a ski boot during skiing. The cushion pads are formed as a sandwich of serially and parallel connected cells arranged between top and bottom layers, which cells and connecting tubes are formed of a somewhat resilient material, and are selectively filled with air, liquid or gel, depending upon the anticipated forces the pad is intended to cushion, the cushion pads to provide an increasing force disperson with increasing pressures.

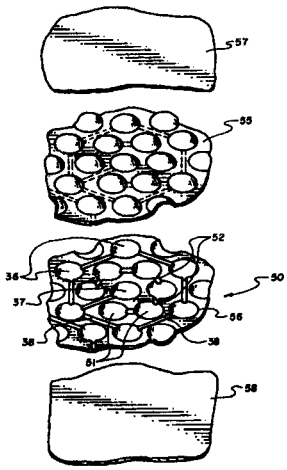

U.S. PATENT DOCUMENTS

| | | | | |
|---|---|---|---|---|
| 3,608,961 | A | | 9/1971 | Von Heck |
| 3,621,489 | A | | 11/1971 | Keller |
| 3,746,605 | A | | 7/1973 | Dillon et al. |
| 3,870,450 | A | | 3/1975 | Graebe |
| 3,982,786 | A | | 9/1976 | Burgin et al. |
| 3,999,220 | A | | 12/1976 | Keltner |
| 4,005,236 | A | | 1/1977 | Graebe |
| 4,067,063 | A | | 1/1978 | Ettinger |
| 4,083,127 | A | | 4/1978 | Hanson |
| 4,099,269 | A | * | 7/1978 | Porner ..... 2/16 |
| 4,102,061 | A | | 7/1978 | Saaristo |
| 4,258,480 | A | | 3/1981 | Famolare, Jr. |
| 4,266,298 | A | | 5/1981 | Graziano |
| 4,279,044 | A | | 7/1981 | Douglas |
| 4,319,412 | A | | 3/1982 | Muller et al. |
| 4,358,902 | A | | 11/1982 | Cole et al. |
| 4,361,969 | A | | 12/1982 | Vermonet |
| 4,373,361 | A | | 2/1983 | Thorneburg |
| 4,414,760 | A | | 11/1983 | Faiella |
| 4,422,183 | A | | 12/1983 | Landi et al. |
| 4,422,194 | A | | 12/1983 | Viesturs et al. |
| 4,438,573 | A | | 3/1984 | McBarron |
| 4,446,634 | A | | 5/1984 | Johnson et al. |
| 4,468,869 | A | | 9/1984 | Fukuoka |
| 4,471,538 | A | | 9/1984 | Pomeranz et al. |
| 4,497,070 | A | | 2/1985 | Cho |
| 4,513,449 | A | | 4/1985 | Donzis |
| 4,541,136 | A | | 9/1985 | Graebe |
| 4,547,978 | A | | 10/1985 | Radford |
| 4,551,379 | A | | 11/1985 | Kerr |
| 4,567,677 | A | | 2/1986 | Zona |
| 4,577,417 | A | | 3/1986 | Cole |
| 4,592,589 | A | | 6/1986 | Hellwig |
| 4,662,087 | A | | 5/1987 | Beuch |
| 4,669,126 | A | | 6/1987 | Jones |
| 4,670,995 | A | | 6/1987 | Huang |
| 4,698,864 | A | | 10/1987 | Graebe |
| 4,722,131 | A | | 2/1988 | Huang |
| 4,730,610 | A | | 3/1988 | Graebe |
| 4,744,157 | A | | 5/1988 | Dubner |
| 4,763,426 | A | | 8/1988 | Polus et al. |
| 4,769,854 | A | | 9/1988 | Williams |
| 4,813,160 | A | | 3/1989 | Kuznetz |
| 4,852,195 | A | | 8/1989 | Schulman |
| 4,864,671 | A | | 9/1989 | Evans |
| 4,869,939 | A | | 9/1989 | Santo |
| 4,888,887 | A | | 12/1989 | Solow |
| 4,905,320 | A | | 3/1990 | Squyers, Jr. |
| 4,936,030 | A | | 6/1990 | Rennex |
| 4,995,173 | A | | 2/1991 | Spier |
| 4,999,931 | A | | 3/1991 | Vermeulen |
| 4,999,932 | A | | 3/1991 | Grim |
| 5,030,501 | A | | 7/1991 | Colvin et al. |

FOREIGN PATENT DOCUMENTS

| | | |
|---|---|---|
| FR | 2356384 | 7/1976 |
| FR | 2413393 | 12/1978 |
| GB | 14955 | of 1894 |
| GB | 440398 | 3/1934 |
| GB | 817521 | 7/1957 |
| GB | 2068710 | 8/1981 |
| GB | 2114424 | 2/1983 |

OTHER PUBLICATIONS

Electronic Clerk's Notes for Order Denying Reeboks Motion for Summary Judgment.
Motion by Reebok For Summary Judgment of Invalidity.
Memorandum in Support of Reebok and Rockport's Motion for Summary Judgment of Invalidity.
Plaintiff Mark Adams' Opposition to Reebok and Rockport's Motion for Summary Judgment on Invalidity.
Exhibits A through F to Adams' Opposition to Reebok and Rockport's Motion for Summary Judgment.
Plaintiff Mark Adams' Statement of Disputed Materials Facts in Support of His Opposition to Reebok and Rockport's Motion for Summary Judgment on Invalidity.
Declaration of Edward Vincent King in Support of Opposition to Motion for Summary Judgment.
Plaintiff Mark Adams' Objections to Defendants' Evidence in Support of His Opposition to Reebok and Rockport's Motion for Summary Judgment.
Plaintiff Mark Adams' Statement of Disputed Material Facts in Support of his Oppositon To Reebok and Rockport's Motion for Summary Judgment.
Reply of Reebok Int'l Ltd. in support of its Motion for Summary Judgment.
Transcripton of the Markman Claim Construction Hearing.
Memorandum of Mark Adams Concerning Claim Construction.
Plaintiff's Claim Construction Exhibits.
Declaration of Edward Vincent King Re: Claim Construction Exhibits.
Declaration of Michael J. Higgins in support of Plaintiff Mark Adams' Response Brief Re Claim Construction.
Plaintiff Mark Adams' Response Brief Re: Claim Construction.
Claim Construction Brief of Defendants.
Reebok and Rockport's Response to Plaintiff's Claim Construction Memorandum.

* cited by examiner

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 2, 4–10, 17, 18 and 25–29 is confirmed.

Claims 1, 3, 11–16 and 19–24 are cancelled.

* * * * *